US009878863B2

(12) United States Patent
Lee et al.

(10) Patent No.: US 9,878,863 B2
(45) Date of Patent: Jan. 30, 2018

(54) DEVICE AND METHOD FOR CONTROLLING PAPER INTERVAL IN PAPER FEEDER OF IMAGE FORMING APPARATUS, AND IMAGE FORMING APPARATUS INCLUDING THE DEVICE

(71) Applicant: S-PRINTING SOLUTION CO., LTD., Suwon-si, Gyeonggi-do (KR)

(72) Inventors: Young-bok Lee, Seoul (KR); Sang-cheol Kim, Hwaseong-si (KR); Taiichi Ominami, Suwon-si (KR); Jin-soo Lee, Yongin-si (KR)

(73) Assignee: S-PRINTING SOLUTION CO., LTD., Suwon-si (KR)

( * ) Notice: Subject to any disclaimer, the term of this patent is extended or adjusted under 35 U.S.C. 154(b) by 0 days.

(21) Appl. No.: 14/335,267

(22) Filed: Jul. 18, 2014

(65) Prior Publication Data

US 2015/0021846 A1 Jan. 22, 2015

(30) Foreign Application Priority Data

Jul. 18, 2013 (KR) ..... 10-2013-0084964

(51) Int. Cl.

*B65H 7/06* (2006.01)
*B65H 3/06* (2006.01)
*B65H 5/06* (2006.01)

(52) U.S. Cl.

CPC ..... *B65H 7/06* (2013.01); *B65H 3/06* (2013.01); *B65H 5/062* (2013.01);
(Continued)

(58) Field of Classification Search

CPC . B65H 3/06; B65H 50/06; B65H 7/04; B65H 7/06; B65H 7/18; B65H 7/20; B65H 2513/10; B65H 2513/108; B65H 2513/21; B65H 2513/511; B65H 2513/53; B65H 2601/121; B65H 2601/122; B65H 2601/123; B65H 5/06

See application file for complete search history.

(56) References Cited

U.S. PATENT DOCUMENTS 5,197,726 A * 3/1993 Nogami ..... 271/110
5,664,771 A * 9/1997 Nagatani ..... B65H 3/0669 271/10.03

(Continued)

FOREIGN PATENT DOCUMENTS

JP 2007-197158 8/2007
JP 2008-113353 5/2008

*Primary Examiner* — Michael C McCullough
(74) *Attorney, Agent, or Firm* — Staas & Halsey LLP

(57) ABSTRACT

Provided are a device and method for controlling a paper interval in a paper feeder of an image forming apparatus, and an image forming apparatus including the device. The device includes: a leading edge sensor configured to detect a leading edge of a sheet of paper when the sheet of paper is picked up and fed as a printing medium; a feed unit configured to accelerate the sheet of paper; and a control unit. If the sheet of paper arrives late at a paper sensing position of the leading edge sensor, the control unit measures a travel time during which the sheet of paper is fed to the paper sensing position, and according to the measured travel time, the control unit varies a time point at which the sheet of paper starts to be accelerated.

10 Claims, 8 Drawing Sheets

(52) U.S. Cl.
CPC .... *B65H 2513/10* (2013.01); *B65H 2513/511* (2013.01); *B65H 2513/514* (2013.01); *B65H 2513/53* (2013.01); *B65H 2701/1311* (2013.01)

(56) References Cited

U.S. PATENT DOCUMENTS

| | | | | |
|---|---|---|---|---|
| 5,924,686 | A * | 7/1999 | Jacobson | B65H 7/00 271/10.03 |
| 6,076,821 | A * | 6/2000 | Embry et al. | 271/10.01 |
| 7,549,632 | B2 | 6/2009 | Kojima et al. | |
| 2008/0106030 | A1* | 5/2008 | Takenaka | 271/259 |

* cited by examiner

DEVICE AND METHOD FOR CONTROLLING PAPER INTERVAL IN PAPER FEEDER OF IMAGE FORMING APPARATUS, AND IMAGE FORMING APPARATUS INCLUDING THE DEVICE

CROSS-REFERENCE TO RELATED APPLICATIONS

This application claims the priority benefit of Korean Patent Application No. 10-2013-0084964, filed on Jul. 18, 2013, in the Korean Intellectual Property Office, the disclosure of which is incorporated herein in its entirety by reference.

BACKGROUND

1. Field

One or more embodiments relate to a paper feeder and an image forming apparatus, and more particularly, to a device and method for controlling a paper interval in a paper feeder of an image forming apparatus, and an image forming apparatus including the device.

2. Description of the Related Art

Recent laser printers or multi-function apparatuses (hereinafter, these will be referred to as laser printing apparatuses) have become fast with the development of printing technology. Paper feeding is considered as one of the most important factors determining the performance of high-speed laser printing apparatuses, and thus many efforts have been made to develop more reliable paper feeding techniques.

As the printing speed of laser printing apparatuses increases, the importance of controlling the distance between printing media such as sheets of paper is also increased. Hereinafter, the distance between sheets of paper may be referred to as a paper interval or interval between sheets of paper. The printing process speed of laser printing apparatuses may be simply increased by increasing the speed of a driving motor. This, however, may increase noise and vibrations and may make it difficult to control images, and thus high-quality, low-noise later printing apparatuses (image forming apparatuses) may not be provided using such a method. Therefore, technology for minimizing the interval between sheets of paper is needed to increase the printing process speed of image forming apparatuses while minimally increasing the speed of a driving motor.

SUMMARY

In an aspect of one or more embodiments, there is provided a device for reducing and stably keeping the interval between sheets of paper in a paper feeder of an image forming apparatus while minimally increasing the process speed of the image forming apparatus, thereby reducing noise and improving image quality of the image forming apparatus as compared with those of an image forming apparatus of the related art.

In an aspect of one or more embodiments, there is provided a method of reducing and stably keeping the interval between sheets of paper in a paper feeder of an image forming apparatus while minimally increasing the process speed of the image forming apparatus, thereby reducing noise and improving image quality of the image forming apparatus as compared with those of an image forming apparatus of the related art.

One or more embodiments include an image forming apparatus including the device.

In an aspect of one or more embodiments, there is provided a device for controlling a paper interval in a paper feeder of an image forming apparatus, the device including: a leading edge sensor configured to detect a leading edge of a sheet of paper when the sheet of paper is picked up and fed as a printing medium; a feed unit configured to accelerate the sheet of paper; and a control unit, wherein if the sheet of paper arrives late at a paper sensing position of the leading edge sensor, the control unit measures a travel time during which the sheet of paper is fed to the paper sensing position, and according to the measured travel time, the control unit varies a time point at which the sheet of paper starts to be accelerated.

The leading edge sensor may be adjacent to a forward roller.

If the leading edge of the sheet of paper is detected by the leading edge sensor as having passed a predetermined position, the control unit may control a pickup roller to retard picking up of the sheet of paper. If the sheet of paper is detected by a registration sensor of a registration unit, the control unit may control the feed unit to stop acceleration of the sheet of paper.

If the travel time is shorter than a first time (B ms), the control unit may drive a feed roller of the feed unit at 1×speed; if the travel time is equal or longer than the first time (B ms) but shorter than a second time (C ms), the control unit may drive the feed roller of the feed unit at 1.3×speed after a time period calculated by subtracting the travel time from a reference time (D ms); and if the travel time is equal to or longer than the second time (C ms) but shorter than a third time (E ms), the control unit immediately may drive the feed roller of the feed unit at 1.3×speed. If the travel time is equal to longer than the third time (E ms), the control unit may determine that paper jams, and may stop feeding of paper.

In an aspect of one or more embodiments, there is provided an image forming apparatus equipped with a device for controlling a paper interval in a paper feeder, the image forming apparatus including: a pickup roller configured to pick up a sheet of paper as a printing medium; a leading edge sensor configured to detect a leading edge of the sheet of paper when the sheet of paper is picked up and fed to an image forming unit as a printing medium; a feed unit configured to accelerate the sheet of paper; a control unit, wherein if the sheet of paper arrives late at a paper sensing position of the leading edge sensor, the control unit measures a travel time during which the sheet of paper is fed to the paper sensing position, and according to the measured travel time, the control unit varies a time point at which the sheet of paper starts to be accelerated; and a registration unit including a registration sensor configured to detect the sheet of paper, the registration unit being configured to correct skew of the leading edge of the sheet of paper and align a leading edge of an image with the leading edge of the sheet of paper.

If the leading edge of the sheet of paper is detected by the leading edge sensor as having passed a predetermined position, the control unit may retard picking up of the sheet of paper. If the sheet of paper is detected by the registration sensor of the registration unit, the control unit may control the feed unit to stop acceleration of the sheet of paper.

If the travel time is shorter than a first time (B ms), the control unit may drive a feed roller of the feed unit at 1×speed; if the travel time is equal or longer than the first time (B ms) but shorter than a second time (C ms), the control unit may drive the feed roller of the feed unit at 1.3×speed after a time period calculated by subtracting the travel time from a reference time (D ms); and if the travel time is equal to or longer than the second time (C ms) but shorter than a third time (E ms), the control unit may immediately drive the feed roller of the feed unit at 1.3× speed. If the travel time is equal to or longer than the third time (E ms), the control unit may determine that paper jams, and may stop feeding of paper.

In an aspect of one or more embodiments, there is provided a method of controlling a paper interval in an image forming apparatus, the method including: detecting a leading edge of a sheet of paper using a leading edge sensor when the sheet of paper is picked up and fed as a printing medium; if the sheet of paper arrives late at a paper sensing position of the leading edge sensor, detecting a travel time taken for the sheet of paper to arrive at the paper sensing position; and varying a time point at which the sheet of paper starts to be accelerated, according to the travel time.

If the leading edge of the sheet of paper is detected by the leading edge sensor as having passed a predetermined position, the method may further include retarding picking up of the sheet of paper.

The varying of the time point may include stopping acceleration of the sheet of paper if the sheet of paper is detected by a registration sensor of a registration unit.

The varying of the time point may include: if the travel time is shorter than a first time (B ms), driving a feed roller of a feed unit to operate at 1×speed, if the travel time is equal or longer than the first time (B ms) but shorter than a second time (C ms), driving the feed roller of the feed unit at 1.3×speed after a time period calculated by subtracting the travel time from a reference time (D ms); and if the travel time is equal to or longer than the second time (C ms) but shorter than a third time (E ms), immediately driving the feed roller of the feed unit at 1.3×speed.

The varying of the time point may include determining that paper jams and stopping feeding of paper if the travel time is equal to or longer than the third time (E ms).

In an aspect of one or more embodiments, there is provided an image forming apparatus equipped with a device for controlling a print medium interval in a print medium feeder, the image forming apparatus including a pickup roller which picks up a sheet of print medium; a leading edge sensor which detects a leading edge of the sheet when the sheet is picked up and fed to an image forming unit; a feeder configured to accelerate the sheet; a controller, wherein if the sheet arrives after a predetermined time at a print medium sensing position of the leading edge sensor, the controller measures a travel time during which the sheet is fed to the print medium sensing position, and according to the measured travel time, the controller varies a time point at which the sheet starts to be accelerated; and a registration unit comprising a registration sensor configured to detect the sheet, the registration unit being configured to correct skew of the leading edge of the sheet and align a leading edge of an image with the leading edge of the sheet.

If the travel time is shorter than a first time, the controller may drive a feed roller of the feeder at 1×speed. If the travel time is equal or longer than the first time but shorter than a second time, the controller may drive the feed roller of the feeder at 1.3×speed after a time period calculated by subtracting the travel time from a reference time. If the travel time is equal to or longer than the second time but shorter than a third time, the controller may immediately drive the feed roller of the feeder at 1.3×speed.

BRIEF DESCRIPTION OF THE DRAWINGS

These and/or other aspects will become apparent and more readily appreciated from the following description of embodiments, taken in conjunction with the accompanying drawings in which.

DETAILED DESCRIPTION

Figure 1:
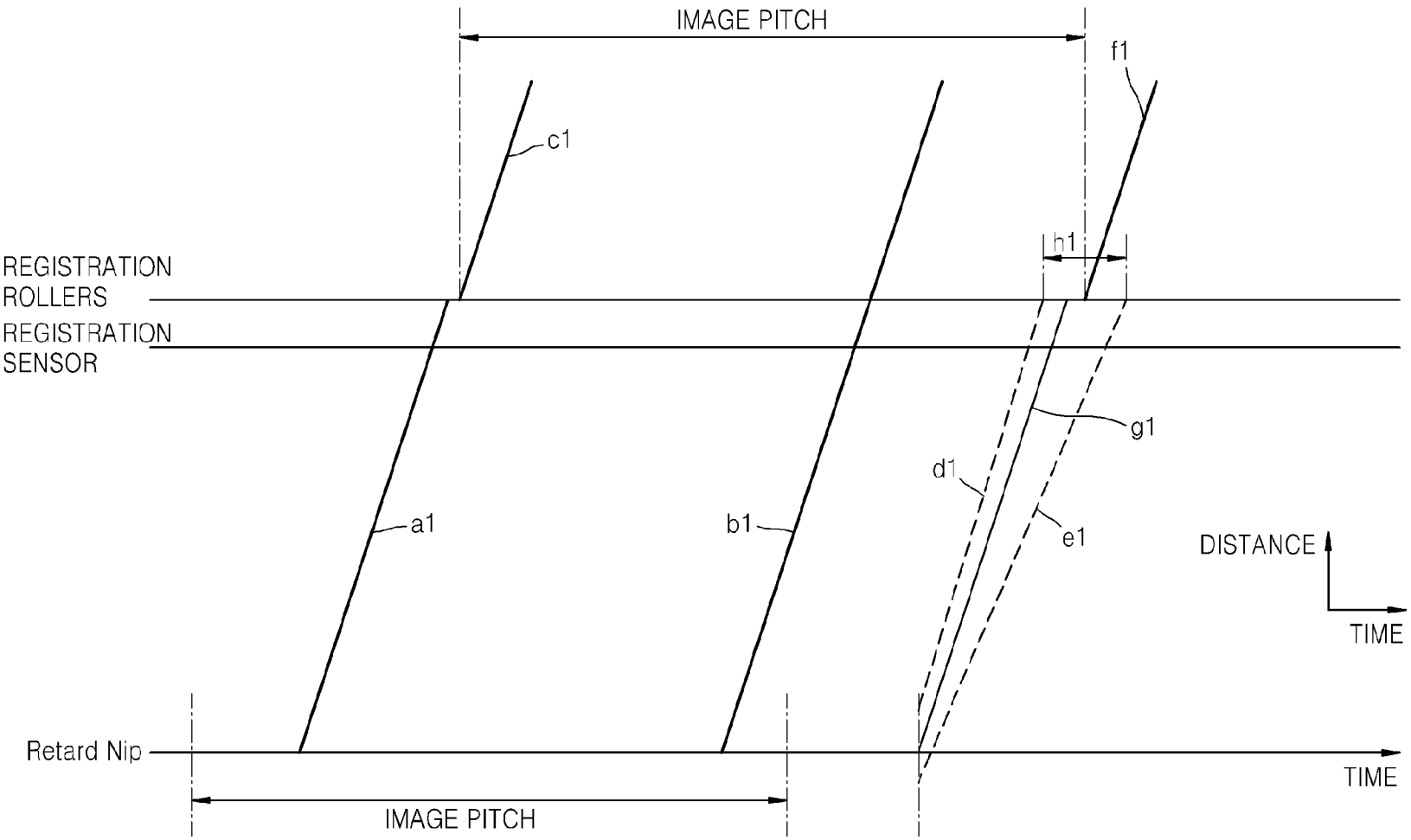
FIG. 1 shows deviations of times taken to pick up sheets of paper and feed the sheets of paper to a registration unit when a leading edge sensor is not provided at a position adjacent to a feeding start position.

Reference will now be made in detail to embodiments, examples of which are illustrated in the accompanying drawings, wherein like reference numerals refer to like elements throughout. In this regard, embodiments may have different forms and should not be construed as being limited to the descriptions set forth herein. Accordingly, embodiments are merely described below, by referring to the figures, to explain aspects of the present description. As used herein, the term "and/or" includes any and all combinations of one or more of the associated listed items.

Although sheets of paper are used in examples below, embodiments are not limited to sheets of paper. Sheets of any type of print medium are also contemplated.

Laser printing apparatuses of the related art are not equipped with a sensor for detecting the leading edge of a sheet of paper when the sheet of paper is picked up and fed to a registration unit. Therefore, the interval between sheets of paper is determined in consideration of the dispersion of edge positions of sheets of paper, and thus a large value is usually determined as the interval and it is difficult to reduce the interval. Herein, the term "dispersion or deviation" is used to express the state in which the preceding sheet of paper is fed late or early from a normal position during printing by a laser printing apparatus.

Factors increasing the interval between sheets of paper include a paper start position, slippage of a pickup roller, connection delays of clutches such as a pickup roller clutch or a registration roller clutch, and accumulated tolerance. Such factors make it difficult to reduce the interval between sheets of paper.

Therefore, in one or more embodiments, if it is detected that the leading edge of a sheet of paper has not yet arrived at a sensing position of a leading edge sensor, a time point at which the sheet of paper starts to be accelerated is determined according to a travel time taken for the sheet of paper to reach the sensing position, so as to remove the effects of factors increasing the interval between sheets of paper and thus to reduce the interval between sheets of paper.

It may be required to reduce the interval between sheets of paper for increasing the speed of printing apparatuses. In the related art, however, since the interval between sheets of paper is determined in consideration of all factors increasing the interval between sheets of paper, there is a limit in increasing the speed of printing apparatuses.

The effects of some of factors increasing the interval between sheets of paper may be removed or reduced by using a leading edge sensor. For example, if a leading edge sensor is used, the effects of factors shown in Table 1 may be removed or reduced to decrease the Interval between sheets of paper.

TABLE 1

| Factors increasing interval between sheets of paper | Ranges | Methods for improvement |
|---|---|---|
| Dispersion of start positions of sheets of paper | +20 to −5 mm | Detect leading edge of paper sheet, Delay pickup timing |
| Pickup slippage | Maximum 20% | Vary acceleration start time according to calculated travel time |
| Dispersion of clutch delays | 50 ms | |

FIG. 1 shows deviations of times taken to pick up sheets of paper and feed the sheets of paper to a registration unit when a leading edge sensor is not provided at a position adjacent to a feeding start position. The abbreviation "mm" refers to millimeters and the term "ms" refers to "milliseconds."

Referring to FIG. 1, reference a1 is a distance-time line providing information about a time taken for the leading edge of the first sheet of paper to move from a retard nip to registration rollers in a printing process, and reference b1 is a distance-time line providing information about a time taken for the trailing edge of the first sheet of paper to move from the retard nip to the registration rollers in the printing process. In addition, reference c1 is a distance-time line providing information about image forming after the leading edge of the first sheet of paper arrives at the registration rollers and skew thereof is corrected. reference g1 is a distance-time line providing information about an ideal time taken for the leading edge of the second sheet of paper to move from the retard nip to the registration rollers without slippage at a pickup roller, and reference f1 is a distance-time line providing information about image forming after the leading edge of the second sheet of paper arrives at the registration rollers and skew thereof is corrected.

Reference d1 is a distance-time line of the leading edge of the second sheet of paper when the leading edge of the second sheet of paper arrives early at the registration rollers as compared with a normal arrival time due to deviation, and reference e1 is a distance-time line of the second sheet of paper when the leading edge of the second sheet of paper arrives late at the registration rollers as compared with the normal arrival time due to deviation. The example of reference e1 shows that the leading edge of the second sheet of paper arrives at the registration rollers later than a start time of image forming, and thus may be treated as a paper jam. Reference h1 denotes an arrival time difference of the leading edge of the second sheet of paper caused by deviation.

As shown in FIG. 1, if a leading edge sensor is not used when sheets of paper start to be sequentially fed, although the positions of the leading edges of the sheets of paper are varied, the sheets of paper are picked up and fed to the registration rollers at preset time intervals. Therefore, arrival times of the sheets of paper to the registration rollers may be markedly deviated.

However, according to one or more embodiments, the interval between sheets of paper may be minimized and stably maintained in laser printing apparatuses, and thus the laser printing apparatuses may have a high printing speed and a high degree of paper feeding quality. For this, in one or more embodiments, a leading edge sensor is used to detect the positions of the leading edges of sheets of paper, and pickup and acceleration timing are controlled according to detection results of the leading edge sensor. In this way, dispersion of paper intervals may be reduced, and sheets of paper may be prevented from overlapping each other while being continuously fed.

Figure 2:
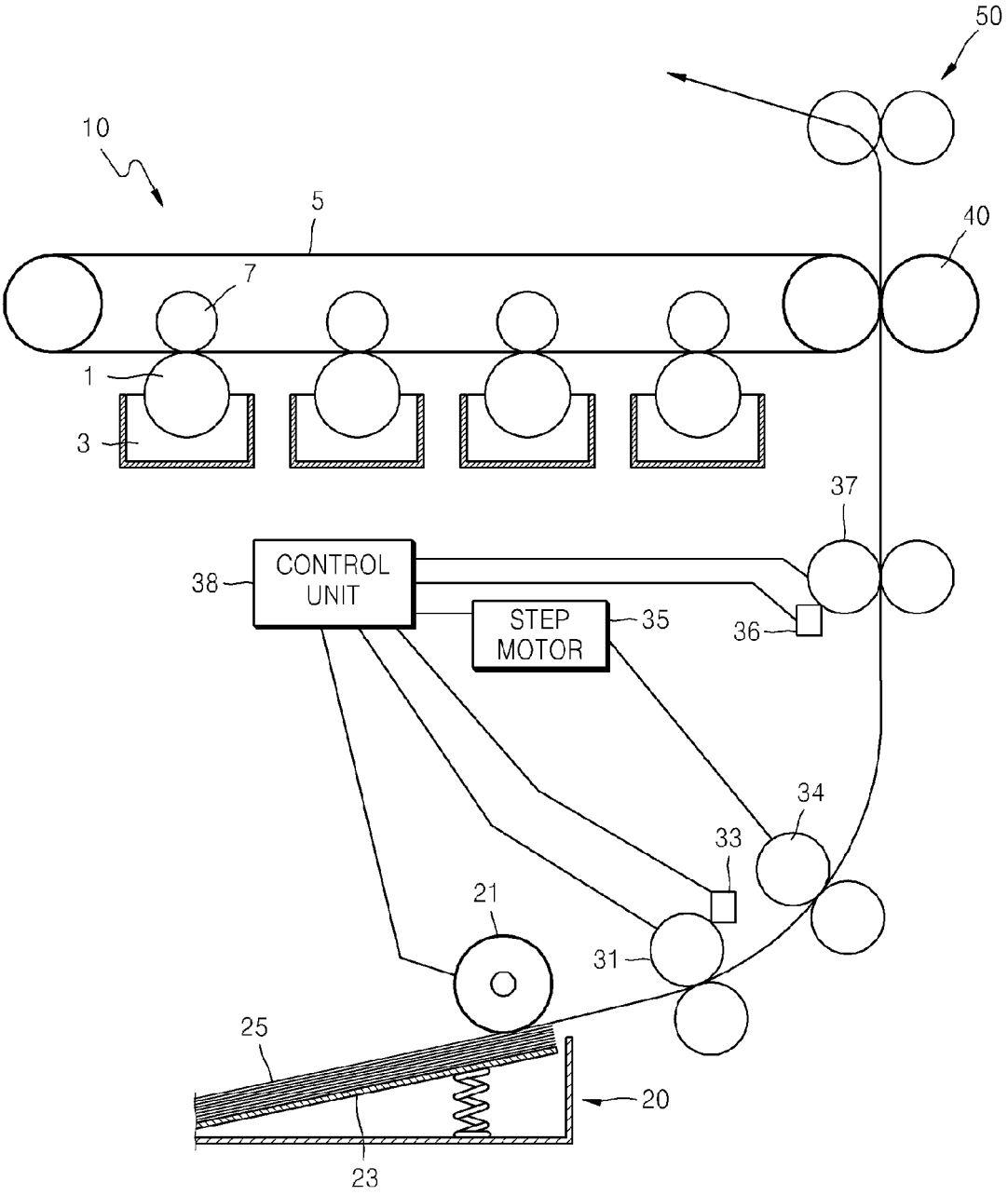
FIG. 2 illustrates a device for controlling a paper interval in a paper feeder of an image forming apparatus, and an image forming apparatus including the device, according to embodiments.

FIG. 2 illustrates a device for controlling a paper interval in a paper feeder of an image forming apparatus, and an image forming apparatus including the device, according to embodiments.

One or more embodiments provide a device for controlling a paper interval in a paper feeder of an image forming apparatus 10. The device includes a leading edge sensor 33, a feed unit (feeder) (34, 35), and a control unit (controller) 38.

The leading edge sensor 33 is used to detect a leading edge of a sheet of paper when sheets of paper (printing media) are picked up from a paper cassette 20 having a tray 23 upon which sheets 25 of paper are placed, so that the sheets are fed to the forward rollers 31 by way of pickup roller 21. The leading edge sensor 33 may be adjacent to forward rollers 31.

The feed unit (34, 35) retards picking up of a sheet of paper or accelerates the sheet of paper according to the position of the sheet of paper relative to the leading edge sensor 33 or an arrival time of the sheet of paper at a sensing position of the leading edge sensor 33. The feed unit (34, 35) includes feed rollers 34 and a step motor 35. The feed rollers 34 are driven by the step motor 35 separate from the feed rollers 34 according to a preset pulse in a pulse signal, so as to move a sheet of paper to registration rollers 37. The feed rollers 34 are driven at a speed varying according to the arrival time of the sheet of paper at the sensing position of the leading edge sensor 33.

That is, the feed rollers 34 are used to feed a sheet of paper to the registration rollers 37 along a feeding passage, and are connected to the step motor 35. The step motor 35 may vary the speed of the feed rollers 34 to accelerate a sheet of paper. If the feed rollers 34 are accelerated, the forward rollers 31 may enter an idle state by an action of a one-way clutch attached to an inside of the forward rollers 31, and thus a load on a sheet of paper is minimized. The sheet of paper is accelerated (increased in linear velocity) while the sheet of paper is fed from the feed rollers 34 to a position at which the sheet of paper is detected by a registration sensor 36, and thus an adequate distance may be obtained between the sheet of paper and the next sheet of paper.

The control unit 38 controls the feeding time and velocity of a sheet of paper. If a sheet of paper arrives late at the paper sensing position of the leading edge sensor 33, the control unit 38 measures a travel time taken for the sheet of paper to arrive at the paper sensing position, and according to the measured travel time, the control unit 38 varies a time point at which the sheet of paper starts to be accelerated. For example, if the travel time is shorter than a first time (B ms), the control unit 38 may drive the feed rollers 34 of the feed unit (34, 35) at 1×speed.

If the travel time is equal to or longer than the first time (B ms) but shorter than a second time (C ms), the control unit 38 may drive the feed rollers 34 at 1.3×speed after a time period calculated by subtracting the travel time from a reference time (D ms). If the travel time is equal to or longer than the second time (C ms) but shorter than a third time (E ms), the control unit 38 may immediately drive the feed rollers 34 at 1.3×speed. In addition, if the travel time is equal to or longer than the third time (E ms), the control unit 38 may determine that paper jams, and may stop feeding of paper.

In addition, if the leading edge of the sheet of paper is detected by the leading edge sensor 33 as having passed a predetermined position, the control unit 38 may control the pickup roller 21 to retard picking up of the sheet of paper. In addition, if the sheet of paper is detected by the registration sensor 36 of a registration unit (36, 37), the control unit 38 may control the feed unit (34, 35) to stop accelerating of the sheet of paper.

An embodiment provides an image forming apparatus equipped with the device for controlling a paper interval in a paper feeder. The image forming apparatus includes the pickup roller 21, the leading edge sensor 33, the feed unit (34, 35), the control unit 38, and the registration unit (36, 37).

The pickup roller 21 picks up sheets of paper (printing media) from the paper cassette 20 for feeding sheets of paper.

The leading edge sensor 33 is used to detect a leading edge of a sheet of paper when sheets of paper (printing media) are picked up from the paper cassette 20 and fed. The leading edge sensor 33 may be adjacent to the forward rollers 31.

The feed unit (34, 35) retards picking up of a sheet of paper or accelerates the sheet of paper according to the position of the sheet of paper relative to the leading edge sensor 33 or an arrival time of the sheet of paper at the sensing position of the leading edge sensor 33. The feed unit (34, 35) includes the feed rollers 34 and the step motor 35. The feed rollers 34 are driven by the step motor 35 separate from the feed rollers 34 according to a preset pulse in a pulse signal, so as to move a sheet of paper to the registration rollers 37. The feed rollers 34 are driven at a speed varying according to the arrival time of the sheet of paper at the sensing position of the leading edge sensor 33.

That is, the feed rollers 34 are used to feed a sheet of paper to the registration rollers 37 along a feeding passage, and are connected to the step motor 35. The step motor 35 may vary the speed of the feed rollers 34 to accelerate a sheet of paper. If the feed rollers 34 are accelerated, the forward rollers 31 may enter an idle state by an action of the one-way clutch attached to an inside of the forward rollers 31, and thus a load on a sheet of paper is minimized. The sheet of paper is accelerated (increased in linear velocity) while the sheet of paper is fed from the feed rollers 34 to a position at which the sheet of paper is detected by the registration sensor 36, and thus an adequate distance may be obtained between the sheet of paper and the next sheet of paper.

If a sheet of paper arrives late at the paper sensing position of the leading edge sensor 33, the control unit 38 measures a travel time taken for the sheet of paper to arrive at the paper sensing position, and according to the measured travel time, the control unit 38 varies a time point at which the sheet of paper starts to be accelerated.

In addition, if the leading edge of the sheet of paper is detected by the leading edge sensor 33 as having passed a predetermined position, the control unit 38 may control the pickup roller 21 to retard picking up of the sheet of paper. In addition, if the sheet of paper is detected by the registration sensor 36 of the registration unit (36, 37), the control unit 38 may control the feed unit (34, 35) to stop accelerating of the sheet of paper. The functions of the control unit 38 are the same as those of the control unit 38 explained in the description of the device for controlling a paper interval in a paper feeder, and thus a more detailed description thereof will not be given.

The registration unit (36, 37) includes the registration sensor 36 for detecting the leading edge of a sheet of paper and correcting skew of the sheet of paper. After correcting skew of a sheet of paper, the registration unit (36, 37) aligns the leading edge of the sheet of paper with the leading edge of an image.

After the leading edge of the sheet of paper is aligned with the leading edge of the image by the registration unit (36, 37), the image is transferred from an intermediate transfer belt 5 to the sheet of paper by transfer unit 40 and is fused on the sheet of paper by a fusing unit (fuser) 50.

At this time, laser beams corresponding to printing data are emitted from a scan unit (scanner) (not shown) toward a plurality of photoconductors 1 to form electrostatic latent images on the photoconductors 1, and a plurality of developing units (developers) 3 develop the electrostatic latent images using color developers. As the intermediate transfer belt 5 is rotated, the developed images are transferred from the photoconductors 1 to the intermediate transfer belt 5 in a superimposed manner by the action of a plurality of transfer rollers 7.

Figure 3:
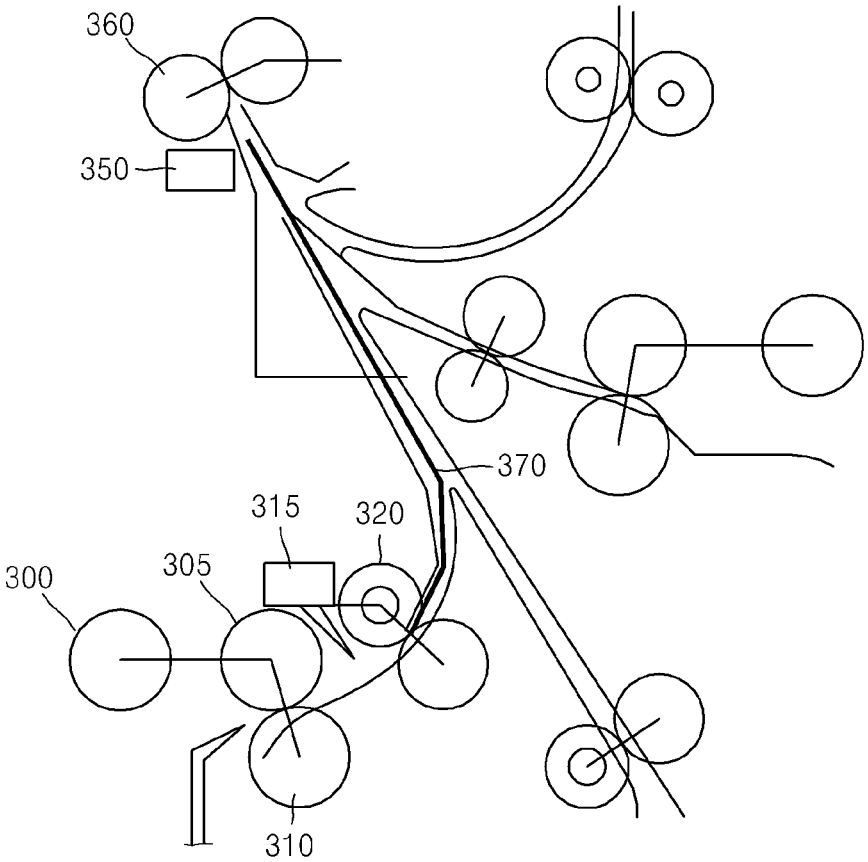
FIG. 3 illustrates an exemplary feeding passage of an image forming apparatus including a feed unit capable of accelerating sheets of paper.

FIG. 3 illustrates an exemplary feeding passage of an image forming apparatus including a feed unit capable of accelerating sheets of paper. A sheet of paper picked up from a cassette (not shown) by a pickup roller 300 is further fed by a forward roller 305 and a retard roller 310 while being prevented from being multi-fed together with other sheets of paper. At this time, according to a time at which the leading edge of the sheet of paper is detected by a leading edge sensor 315 (that is, the arrival time of the sheet of paper), a control unit (not shown) retards pickup timing or controls feed rollers 320 to accelerate the sheet of paper along a feeding passage 370. In the latter example, acceleration of the sheet of paper is stopped if the sheet of paper is detected by a registration sensor 350. After the sheet of paper is fed along the feeding passage 370, the leading edge of the sheet of paper is aligned by registration rollers 360, and an image is formed on the sheet of paper.

Figure 4:
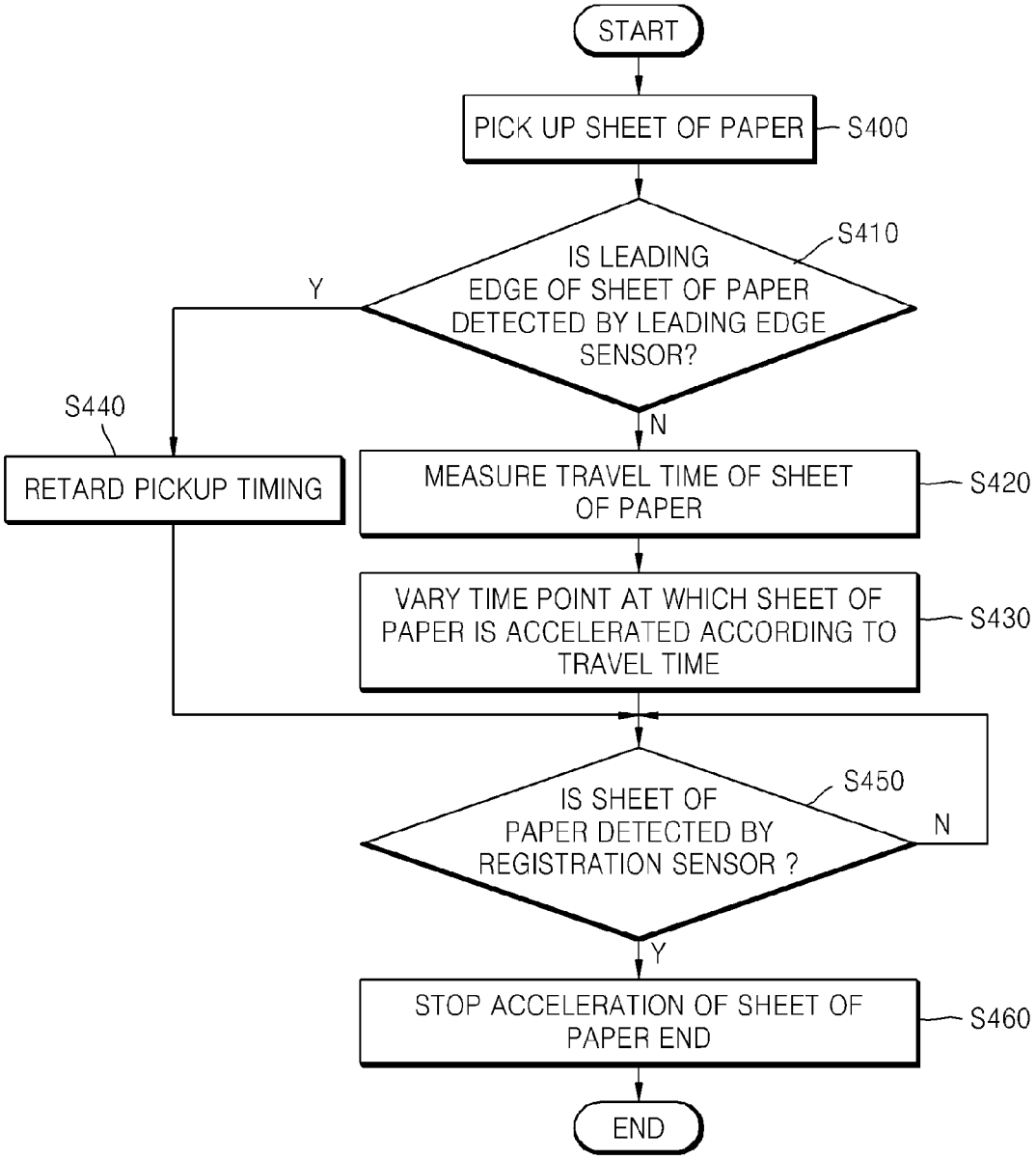
FIG. 4 is a flowchart illustrating a method of controlling a paper interval in a paper feeder of an image forming apparatus, according to an embodiment.

FIG. 4 is a flowchart illustrating a method of controlling a paper interval in a paper feeder of an image forming apparatus, according to an embodiment.

With reference to FIGS. 2 and 4, the method of controlling a paper interval in a paper feeder of an image forming apparatus will be described according to an embodiment.

In an embodiment, the interval between sheets of paper is controlled based on whether the leading edge sensor 33 detects a sheet of paper and a travel time taken for the sheet of paper to arrive at the sensing position of the leading edge sensor 33.

Sheets of paper to be used in printing are stored in the paper cassette 20, and the first sheet of paper may be at an initial (start) position. However, as printing proceeds, the start position of a sheet of paper may be varied forward due to friction with the preceding sheet of paper or backward due to a movement of a rear guide. In the related art, since a leading edge sensor is not used, the leading edge of a sheet of paper is not detected, and thus the interval between sheets of paper is calculated (determined) in consideration of such variations of the start positions of sheets of paper. Therefore, if the effect of such variations is removed, the interval between sheets of paper may be reduced, and thus the speed of printing apparatuses may be increased.

Therefore, a reflective type paper leading edge sensor such as the leading edge sensor 33 may be used to detect the leading edge of a sheet of paper. If the leading edge of a sheet of paper is placed after the sensing position of the leading edge sensor 33, the leading edge sensor 33 may detect this, and pickup timing of the pickup roller 21 may be retarded. If the leading edge of a sheet of paper does not protrudes (that is, if the sheet of paper is not yet at the sensing position of the leading edge sensor 33), a travel time of the sheet of paper to the sensing position is measured, and the travel time may be divided into periods to control the feeding speed of the sheet of paper according to the periods. In this way, the interval between a sheet of paper and the preceding sheet of paper may be maintained without an overlap therebetween. Therefore, as compared with the related art, dispersion of sheets of paper at the registration rollers 37 may be reduced, and thus the interval between sheets of paper may be stably maintained. That is, the distance between sheets of paper may be stably controlled by retarding paper pickup timing or accelerating paper feeding according to results of detection of the positions of the leading edges of the sheets of paper.

The method will now be described in more detail. A sheet of paper (printing medium) is picked up from the paper cassette 20 using the pickup roller 21 (operation S400). When the sheet of paper is picked up and fed, it is checked whether the leading edge of the sheet of paper is detected by the leading edge sensor 33 (operation S410).

If the sheet of paper arrives late at the paper sensing position of the leading edge sensor 33, the control unit 38 measures a travel time taken for the sheet of paper to arrive at the paper sensing position (operation S420).

According to the travel time, the control unit 38 varies a time point at which the sheet of paper is accelerated (operation S430).

In operation, if the leading edge of the sheet of paper is detected by the leading edge sensor 33 as having passed the sensing position of the leading edge sensor 33, the control unit 38 controls the pickup roller 21 to retard picking up of the sheet of paper (operation S440).

Thereafter, if the sheet of paper is detected by the registration sensor 36 of the registration unit (36, 37) (operation S450), the control unit 38 controls the feed rollers 34 to stop acceleration of the sheet of paper (operation S460).

Figure 5A:
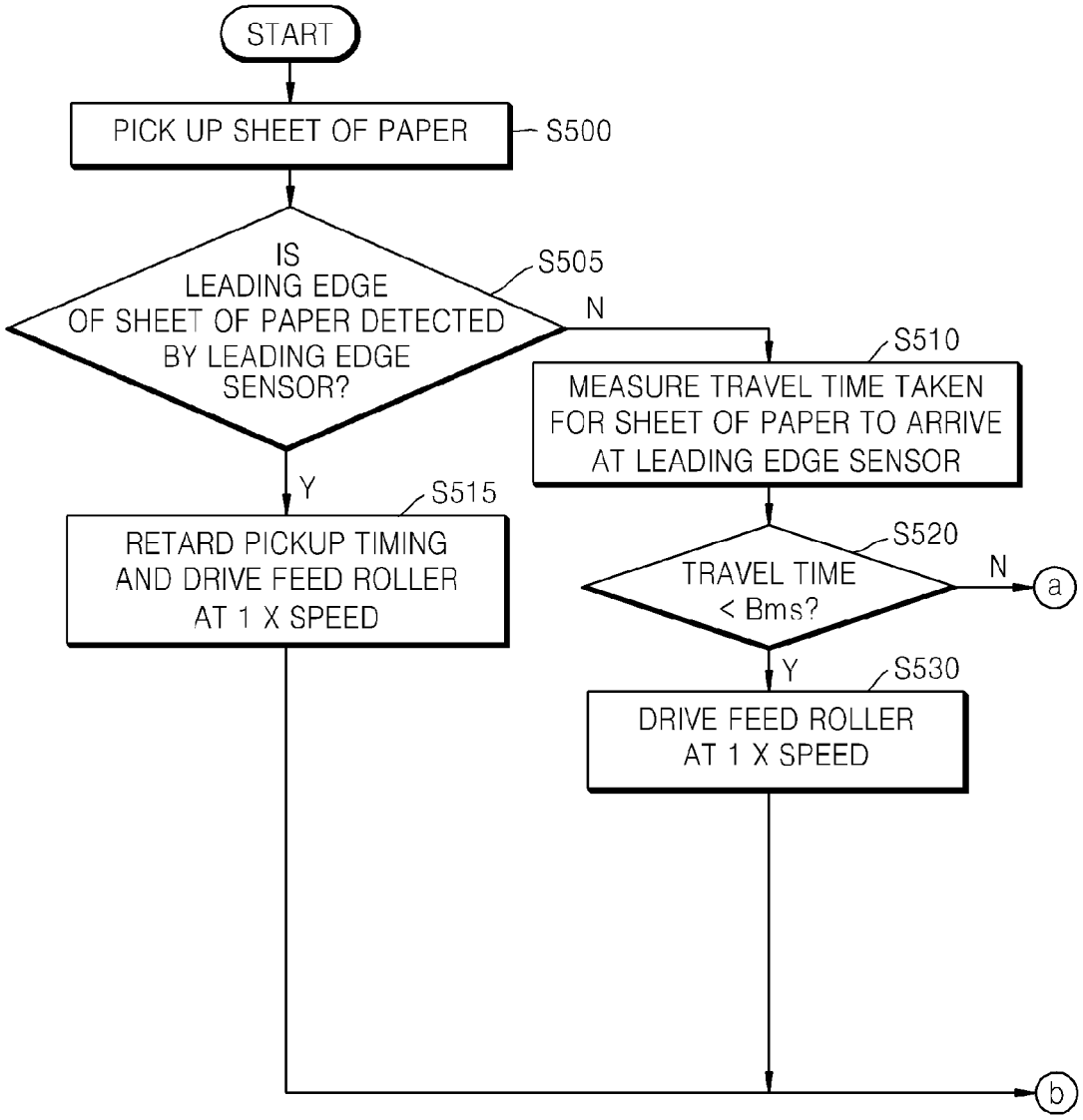
FIGS. 5A and 5B are flowcharts illustrating an example of the method of controlling a paper interval in a paper feeder of an image forming apparatus, according to an embodiment.
Figure 5B:
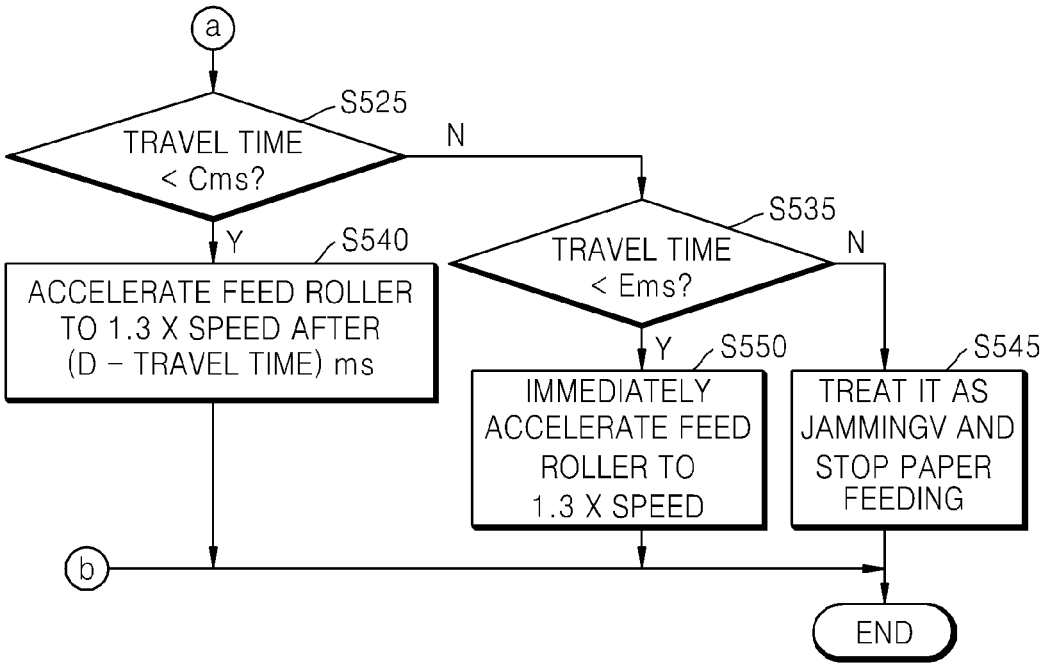

FIGS. 5A and 5B are flowcharts illustrating an example of the method of controlling a paper interval in a paper feeder of an image forming apparatus, according to an embodiment. In an example of a method, the feeding speed of a sheet of paper is correlated with the operation of the leading edge sensor 33.

Referring to FIGS. 2 and 5, the pickup roller 21 picks up a sheet of paper (printing medium) (operation S500). When the sheet of paper is picked up and fed, it is checked whether the leading edge of the sheet of paper is detected by the leading edge sensor 33 (operation S505).

If the sheet of paper arrives late at the paper sensing position of the leading edge sensor 33 (that is, if the leading edge sensor 33 is not blocked by the sheet of paper), the control unit 38 measures a travel time taken for the sheet of paper to arrive at the paper sensing position to select a control method for the sheet of paper (operation S510).

In operation S505, if the leading edge of the sheet of paper is detected by the leading edge sensor 33 as having passed the sensing position of the leading edge sensor 33, the control unit 38 controls the pickup roller 21 to retard picking up of the sheet of paper and drives the feed rollers 34 at 1×speed (operation S515).

If the travel time is shorter than a first time (B ms) (operation S520), the control unit 38 drives the feed rollers 34 of the feed unit (34, 35) at 1×speed (operation S530).

If the travel time is equal to or longer than the first time (B ms) but shorter than a second time (C ms) (operation S525), the control unit 38 drives the feed rollers 34 at 1.3×speed after a time period calculated by subtracting the travel time from a reference time (D ms) (operation S540).

In operation 535, if it is determined that the travel time is equal to or longer than the second time (C ms) but shorter than a third time (E ms), the control unit 38 immediately drives the feed rollers 34 at 1.3×speed (operation S550).

In operation S535, if it is determined that the travel time is equal to or longer than the third time (E ms), the control unit 38 determines that paper jams, and stops feeding of the sheet of paper (operation S545).

Figure 6:
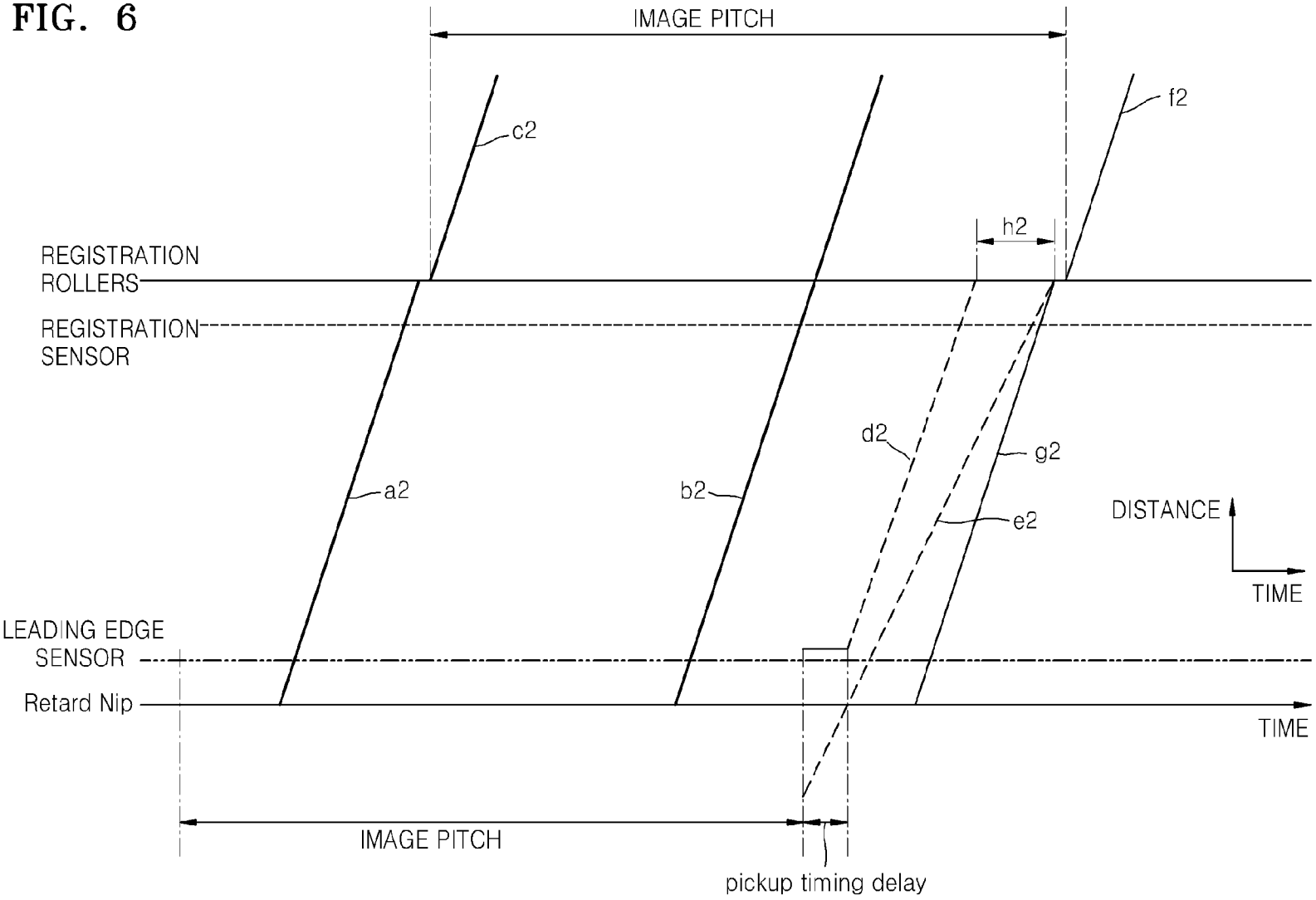
FIG. 6 illustrates retarding of pickup timing when the leading edge of a sheet of paper is detected by a leading edge sensor.

FIG. 6 illustrates retarding of pickup timing when the leading edge of a sheet of paper is detected by the leading edge sensor 33.

Referring to FIG. 6, reference a2 is a distance-time line providing information about a time taken for the leading edge of the first sheet of paper to move from the retard nip to the registration rollers 37 in a printing process, and reference b2 is a distance-time line providing information about a time taken for the trailing edge of the first sheet of paper to move from the retard nip to the registration rollers 37 in the printing process. In addition, reference c2 is a distance-time line providing information about image forming after the leading edge of the first sheet of paper arrives at the registration rollers 37 and skew thereof is corrected. Reference g2 is a distance-time line providing information about an ideal time taken for the leading edge of the second sheet of paper to move from the retard nip to the registration rollers 37 without slippage at the pick-up roller 21, and reference f2 is a distance-time line providing information about image forming after the leading edge of the second sheet of paper arrives at the registration rollers 37 and skew thereof is corrected.

Reference d2 is a distance-time line of the leading edge of the second sheet of paper when the leading edge of the second sheet of paper arrives very early at the registration rollers 37 as compared with a normal arrival time due to deviation. In this example, pickup timing of the pickup roller 21 may be retarded. Reference e2 is a distance-time line of the leading edge of the second sheet of paper when the leading edge of the second sheet of paper arrives early at the registration rollers 37 as compared with a normal arrival time due to deviation. In this example, however, pickup timing of the pickup roller 21 may not be retarded because the early arrival of the leading edge of the second sheet of paper is within an allowable range. Reference h2 denotes a time difference between the arrival times of the leading edge of the second sheet of paper in the examples of reference d2 and reference e2.

As shown in FIG. 6, if the leading edge sensor 33 is used to detect the leading edge of a sheet of paper when the sheet of paper starts to be fed, although the leading edge of the sheet of paper is deviated (for example, although the leading edge of the sheet of paper protrudes from a normal position), the arrival time of the leading edge of the sheet of paper at the registration rollers 37 may be less deviated by retarding the pickup timing of the sheet of paper, and thus an image forming process may be normally performed.

Figure 7:
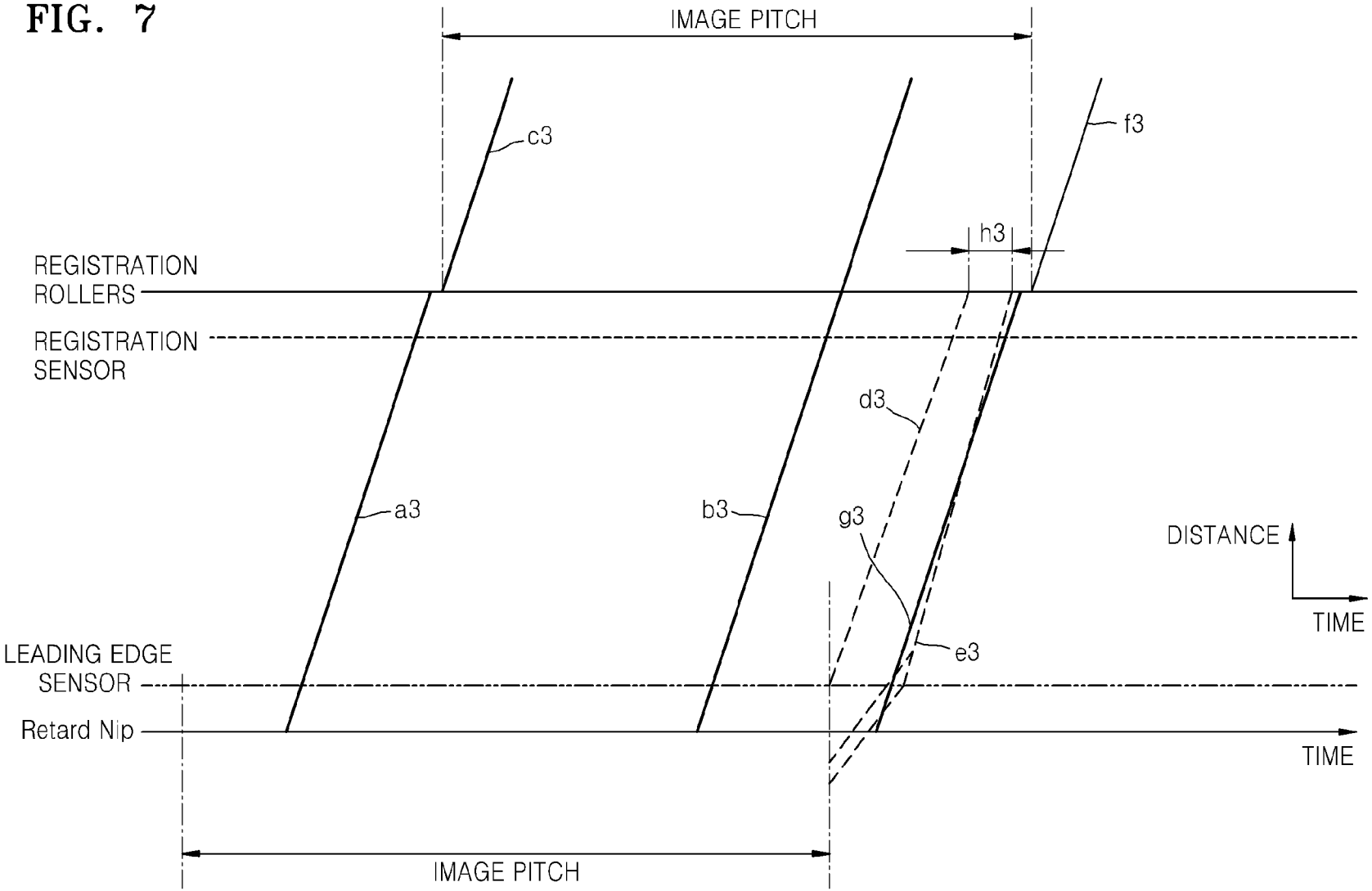
FIG. 7 illustrates acceleration of paper feeding when the leading edge of a sheet of paper is not detected by a leading edge sensor.

FIG. 7 illustrates acceleration of paper feeding when the leading edge of a sheet of paper is not detected by the leading edge sensor 33.

Referring to FIG. 7, reference a3 is a distance-time line providing information about a time taken for the leading edge of the first sheet of paper to move from the retard nip to the registration rollers 37 in a printing process, and reference b3 is a distance-time line providing information about a time taken for the trailing edge of the first sheet of paper to move from the retard nip to the registration rollers 37 in the printing process. In addition, reference c3 is a distance-time line providing information about image forming after the leading edge of the first sheet of paper arrives at the registration rollers 37 and skew thereof is corrected. Reference g3 is a distance-time line providing information about an ideal time taken for the leading edge of the second sheet of paper to move from the retard nip to the registration rollers 37 without slippage at the pick-up roller 21, and reference f3 is a distance-time line providing information about image forming after the leading edge of the second sheet of paper arrives at the registration rollers 37 and skew thereof is corrected.

Reference d3 is a distance-time line of the leading edge of the second sheet of paper when the leading edge of the second sheet of paper arrives early at the registration rollers 37 as compared with a normal arrival time due to deviation. In this example, however, since the early arrival of the leading edge of the second sheet of paper is within an allowable range, the sheet of paper is fed at a normal speed (1×speed) without retarding pickup timing of the pickup roller 21.

Reference e3 shows the example in which the leading edge of the second sheet of paper arrives late at the registration rollers 37 due to deviation. In this example, a travel time taken for the second sheet of paper to arrive at the sensing position of the leading edge sensor 33 is measured, and according to the travel time, the second sheet of paper is accelerated immediately or after a predetermined period of time.

Reference h3 denotes a time difference between the arrival times of the leading edge of the second sheet of paper in the examples of reference d3 and reference e3.

As shown in FIG. 7, if the leading edge sensor 33 is used to detect the leading edge of a sheet of paper when the sheet of paper starts to be fed, although the leading edge of the sheet of paper is deviated (for example, although the sheet of paper is fed late), the sheet of paper may be used for forming an image thereon without being treated as a jammed sheet of paper by accelerating feeding of the sheet of paper.

As described above, in the related art, the interval between sheets of paper is increased due to dispersion of the leading edges of sheets of paper and dimensional tolerances of components. However, according to the one or more embodiments, the paper interval controlling device and method, and the image forming apparatus including the device are designed to reduce the interval between sheets of paper by detecting dispersion of the leading edges of sheets of paper and varying pickup timing and feeding speed of the sheets of paper according to the detection results.

In addition, according to one or more embodiments, the interval between sheets of paper in laser printing apparatuses may be reduced and stably maintained for reliably feeding sheets of paper and performed printing at high speed without increasing the process speed of the laser printing apparatuses. Therefore, laser printing apparatuses having improved image quality and generating less noise may be provided.

It should be understood that exemplary embodiments described therein should be considered in a descriptive sense only and not for purposes of limitation. Descriptions of features or aspects within each embodiment should typically be considered as available for other similar features or aspects in other embodiments.

While one or more embodiments have been described with reference to the figures, it will be understood by those of ordinary skill in the art that various changes in form and details may be made therein without departing from the spirit and scope of the disclosure as defined by the following claims.

What is claimed is:

1. A device for controlling a paper interval in a paper feeder of an image forming apparatus, the device comprising:

a leading edge sensor configured to detect a leading edge of a sheet of paper when a pickup roller picks up the sheet of paper and a forward roller forwards the sheet of paper, wherein the leading edge sensor is adjacent to an output side of the forward roller;

a feeder configured to accelerate the sheet of paper; and a controller, wherein if the sheet of paper arrives at a paper sensing position of the leading edge sensor subsequent to a predetermined time, the controller measures a travel time during which the sheet of paper is fed to the paper sensing position, and according to the measured travel time, the controller varies a time point at which the sheet of paper starts to be accelerated, wherein if the leading edge of the sheet of paper is detected by the leading edge sensor as having passed a predetermined position prior to the predetermined time, the controller controls a motor driving the pickup roller to retard driving timing of the pickup roller for retarding picking up timing of a next sheet of paper;

wherein the controller maintains driving speed of a feed roller of the feeder in response to a determination that the travel time is shorter than a first time;

wherein the controller determines the time point at which the driving speed starts to be accelerated according to the travel time in response to a determination that the travel time is equal or longer than the first time but shorter than a second time; and wherein if the travel time is equal to or longer than the second time, the controller determines that the sheet of paper jams, and stops feeding of the sheet of paper.

2. The device of claim 1, wherein if the sheet of paper is detected by a registration sensor of a registration unit, the controller controls the feeder to stop acceleration of the sheet of paper.

3. The device of claim 1, wherein the sheet of paper picked up by the pickup roller is picked up from a cassette and fed by the forward roller and a retard roller while being prevented from being multi-fed together with other sheets of paper.

4. An image forming apparatus comprising:

a pickup roller configured to pick up a sheet of paper as a printing medium;

a leading edge sensor configured to detect a leading edge of the sheet of paper when the sheet of paper is picked up and fed by a forward roller to an image forming unit, wherein the leading edge sensor is adjacent to an output side of the forward roller;

a feeder configured to accelerate the sheet of paper; and a controller, wherein if the sheet of paper arrives at a paper sensing position of the leading edge sensor subsequent to a predetermined time, the controller measures a travel time during which the sheet of paper is fed to the paper sensing position, and according to the measured travel time, the controller varies a time point at which the sheet of paper starts to be accelerated, wherein if the leading edge of the sheet of paper is detected by the leading edge sensor as having passed a predetermined position prior to the predetermined time, the controller retards driving timing of a motor driving the pickup roller to retard picking up timing of a next sheet of paper;

wherein the controller maintains driving speed of a feed roller of the feeder in response to a determination that the travel time is shorter than a first time;

wherein the controller determines a time point at which the driving speed starts to be accelerated according to the travel time in response to a determination that the travel time is equal or longer than the first time but shorter than a second time; and wherein if the travel time is equal to or longer than the second time, the controller determines that the sheet of paper jams, and stops feeding of the sheet of paper.

5. The image forming apparatus of claim 4, wherein the sheet of paper picked up by the pickup roller is picked up from a cassette and fed by the forward roller and a retard roller while being prevented from being multi-fed together with other sheets of paper.

6. The image forming apparatus of claim 4, further comprising:

a registration unit comprising a registration sensor configured to detect the sheet of paper, the registration unit being configured to correct skew of the leading edge of the sheet of paper and align a leading edge of an image with the leading edge of the sheet of paper.

7. The image forming apparatus of claim 6, wherein if the sheet of paper is detected by the registration sensor of the registration unit, the controller controls the feeder to stop acceleration of the sheet of paper.

8. A method of controlling a paper interval in an image forming apparatus, the method comprising:

picking up and forwarding a sheet of paper as a printing medium using a pickup roller and a forward roller;

detecting a leading edge of the sheet of paper using a leading edge sensor, wherein the leading edge sensor is adjacent to an output side of the forward roller;

if the sheet of paper arrives at a paper sensing position of the leading edge sensor subsequent to a predetermined time, detecting a travel time taken for the sheet of paper to arrive at the paper sensing position;

varying a time point at which the sheet of paper starts to be accelerated by a feed roller, according to the travel time;

if the leading edge of the sheet of paper is detected by the leading edge sensor as having passed a predetermined position prior to the predetermined time, retarding driving timing of a motor driving the pickup roller to retard picking up timing of a next sheet of paper, wherein the varying of the time point comprises:

maintaining driving speed of the feed roller in response to a determination that the travel time is shorter than a first time;

determining the time point at which the driving speed starts to be accelerated according to the travel time in response to a determination that the travel time is equal or longer than the first time but shorter than a second time; and if the travel time is equal to or longer than the second time, determining that the paper jams and stopping feeding of the paper.

9. The method of claim 8, wherein the varying of the time point comprises stopping acceleration of the sheet of paper if the sheet of paper is detected by a registration sensor of a registration unit.

10. The method of claim 8, wherein the sheet of paper picked up by the pickup roller is picked up from a cassette and fed by the forward roller and a retard roller while being prevented from being multi-fed together with other sheets of paper.

* * * * *